US005777593A

United States Patent [19]

Kondoh

[11] Patent Number: 5,777,593

[45] Date of Patent: Jul. 7, 1998

[54] DRIVING METHOD AND SYSTEM FOR ANTIFERROELECTRIC LIQUID-CRYSTAL DISPLAY DEVICE

[75] Inventor: Shinya Kondoh, Tokorozawa, Japan

[73] Assignee: Citizen Watch Co., Ltd., Tokyo, Japan

[21] Appl. No.: 765,768

[22] PCT Filed: May 9, 1997

[86] PCT No.: PCT/JP96/01229

§ 371 Date: Jan. 7, 1997

§ 102(e) Date: Jan. 7, 1997

[87] PCT Pub. No.: WO96/35976

PCT Pub. Date: Nov. 14, 1996

[30] Foreign Application Priority Data

May 11, 1995 [JP] Japan ..... 70112741

[51] Int. Cl.[6] ..... G09G 3/36

[52] U.S. Cl. ..... 345/97; 345/89; 345/96

[58] Field of Search ..... 345/94, 96, 97, 345/89, 208, 209, 210

[56] References Cited

U.S. PATENT DOCUMENTS 5,459,481 10/1995 Tanaka et al. ..... 345/97

FOREIGN PATENT DOCUMENTS 3-37622 2/1991 Japan .

6-160812 6/1994 Japan .

6-202078 7/1994 Japan .

*Primary Examiner*—Matthew Luu

*Attorney, Agent, or Firm*—Finnegan, Henderson, Farabow, Garrett & Dunner, L.L.P.

[57] ABSTRACT

The present invention relates to a driving method and system for an antiferroelectric liquid-crystal display device or, in particular, a gray-scale display method for realizing low cost without an increase in power consumption by controlling the state of an antiferroelectric liquid crystal frame by frame. According to the present invention, writing of pixels requires at least two scanning periods. Each scanning period is composed of a plurality of frames. Both frames during which the antiferroelectric liquid crystal assumes a first ferroelectric state and frames during which the antiferroelectric liquid crystal assumes a second ferroelectric state are not included in the same scanning period (FIG. 1).

12 Claims, 8 Drawing Sheets

DRIVING METHOD AND SYSTEM FOR ANTIFERROELECTRIC LIQUID-CRYSTAL DISPLAY DEVICE

DESCRIPTION

1. TECHNICAL FIELD

The present invention relates to a driving method and system for an antiferroelectric liquid-crystal display device using an antiferroelectric liquid crystal as a liquid-crystal layer and having pixels in the form of a matrix. In particular, this invention is concerned with a gray-scale display method and system for an antiferroelectric liquid-crystal display device. The present invention can be adopted widely for a liquid-crystal display panel, liquid-crystal light shutter array, and the like.

2. BACKGROUND ART

As is already known, a liquid crystal in which dipoles have spontaneous polarizations whose orientations are spontaneously aligned with one another due to dipole interaction, and the orientations of the spontaneous polarizations are reversed with application of an external electric field is referred to as a ferroelectric liquid crystal. In contrast, a liquid crystal in which dipoles of adjoining molecules in a liquid-crystal layer are arranged in anti-parallel so that the spontaneous polarizations of the dipoles are canceled out, and thus exhibit an antiferroelectric state is referred to as an antiferroelectric liquid crystal.

In recent years, many studies and practical application have been made on the former ferroelectric liquid crystal, and the ferroelectric liquid crystal has been applied to various products. However, as is well known, there is a demand for further improvements in terms of the luminance, responsiveness, angle of visibility, and the like of a display screen.

In contrast, as for the latter antiferroelectric liquid crystal, for example, Japanese Unexamined Patent Publication No. 2-173724 has suggested that the angle of visibility is larger than that permitted by a known nematic liquid crystal, the response speed is higher, and the multiplexing ability is better. The antiferroelectric liquid crystal is under earnest study in various aspects.

The present invention attempts to improve a gray-scale display method for an antiferroelectric liquid-crystal display screen as part of a driving method for a display device adopting the latter antiferroelectric liquid crystal. According to the present invention, there is provided a gray-scale display method and system making it possible to reduce the cost of an antiferroelectric liquid-crystal display device and minimize the power consumption.

DISCLOSURE OF THE INVENTION

An object of the present invention is to provide a driving method for a display device adopting an antiferroelectric liquid crystal, or in particular, a gray-scale display method and system making it possible to reduce the cost of an antiferroelectric liquid-crystal display device and minimize the power consumption by improving a gray-scale display method for a liquid-crystal display screen.

According to the present invention, there is provided a driving method for an antiferroelectric liquid-crystal display device including pixels in the form of a matrix and having an antiferroelectric liquid crystal interposed between a pair of substrates. The antiferroelectric liquid crystal assumes a first ferroelectric state, a second ferroelectric state to be set with application of a voltage that is opposite in polarity to a voltage to be applied to set the first ferroelectric state, and an antiferroelectric state.

Writing of pixels is carried out during at least two consecutive scanning periods. Each scanning period is composed of a plurality of frames. Furthermore, an average value of amounts of light transmitted during the plurality of frames is set as an amount of light transmitted by pixels. Moreover, both frames during which the antiferroelectric liquid crystal exhibits the first ferroelectric state and frames during which the antiferroelectric liquid crystal exhibits the second ferroelectric state are not included in the same scanning period.

According to the present invention, one scanning period includes frames during which the first ferroelectric state is set and frames during which the antiferroelectric state is set or to includes frames during which the second ferroelectric state is set and frames during which the antiferroelectric state is set.

Preferably, the transition from a frame during which the antiferroelectric liquid crystal assumes the antiferroelectric state to a frame during which the antiferroelectric liquid crystal assumes the first or second ferroelectric state or the transition from a frame during which the antiferroelectric liquid crystal assumes the first or second ferroelectric state to a frame during which the antiferroelectric liquid crystal assumes the antiferroelectric state is made at most once within the same scanning period.

According to the present invention, there is provided a driving method for an antiferroelectric liquid-crystal display device including pixels in the form of a matrix, and having an antiferroelectric liquid crystal interposed between a pair of substrates that have a plurality of scan electrodes and a plurality of signal electrodes on opposed sides thereof. The antiferroelectric liquid crystal assumes three orderings; a first ferroelectric state, a second ferroelectric state to be set with application of a voltage that is opposite in polarity to a voltage to be applied to set the first ferroelectric state, and an antiferroelectric state.

Writing of pixels located at positions at which the scan electrodes and signal electrodes are opposed mutually is carried out during at least two consecutive scanning periods. Each scanning period is composed of a plurality of frames. Moreover, an average value of amounts of light transmitted during the plurality of frames is set as an amount of light transmitted by pixels. Furthermore, each of the plurality of frames includes at least a selection period during which any of the three orderings of the antiferroelectric liquid crystal is determined, and a non-selection period during which the ordering of the antiferroelectric liquid crystal determined during the selection period is retained. Voltages to be applied to scan electrodes during non-selection periods within the same scanning period have the same polarity.

More preferably, non-selection periods during which the antiferroelectric liquid crystal assumes different orderings are included in at most one pair of consecutive frames within the same scanning period. Moreover, the polarities of voltages to be applied during two consecutive scanning periods are mutually opposite with respect to 0 V.

According to the present invention, there is provided a driving system for an antiferroelectric liquid-crystal display device including pixels in the form of a matrix and having an antiferroelectric liquid crystal interposed between a pair of substrates. The driving system comprises a means for generating display data, a means for driving scan electrodes, a means for driving signal electrodes, a power supply means for supplying a given voltage to pixels, and a control means for receiving display data, producing the timing and voltage values of signals corresponding to the display data, and supplying the timing and voltage values to the scan electrode driving means and signal electrode driving means.

The control means gives control so that writing of pixels is carried out during at least two consecutive scanning periods, each scanning period is composed of a plurality of frames, an average value of amounts of light transmitted during the plurality of frames is set as an amount of light transmitted by pixels, and both frames during which the antiferroelectric liquid crystal assumes a first ferroelectric state and frames during which the antiferroelectric liquid crystal assumes a second ferroelectric state are not included in the same scanning period.

BEST MODE FOR CARRYING OUT THE INVENTION

Prior to a gray-scale display method for an antiferroelectric liquid-crystal display device in accordance with the present invention, the arrangement and light transmittance of antiferroelectric liquid-crystal cells to which the present invention is adapted will be described in conjunction with FIGS. 6, 7, and 8. Problems with known driving methods will be described in conjunction with FIGS. 9A to 10.

As a known fundamental fact, molecules of an antiferroelectric liquid crystal each move along the lateral side of a cone in line with a change in an external electric field. The cone is referred to as a liquid-crystal cone. The liquid-crystal cones are arranged vertically to substrates having liquid-crystal cells between them, and form a layer structure within each liquid-crystal cell. Moreover, the molecules of an antiferroelectric liquid crystal have spontaneous polarizations. The major axes of the molecules in the same liquid-crystal layer are arranged in the same direction, and the spontaneous polarizations of the molecules are also arranged in the same direction; an up or down direction. However, in the absence of an external electric field, as far as adjoining layers are concerned, the major-axis direction of the molecules in one layer is shifted by 180° from that of the molecules in an adjoining layer. The orientation of the spontaneous polarizations of the molecules in one layer is different by 180° from that in an adjoining layer. In other words, if the spontaneous polarizations in a certain layer are oriented up, those in adjoining layers are oriented down. If an external electric field is applied to antiferroelectric liquid-crystal cells vertically with respect to the surfaces of the substrates, the spontaneous polarizations of all molecules are aligned with a direction in which the external electric field is canceled. The molecules therefore move along the lateral sides of liquid-crystal cones. The orientations of the spontaneous polarizations in all layers are unified into the same direction; an up or down direction.

Figure 6:
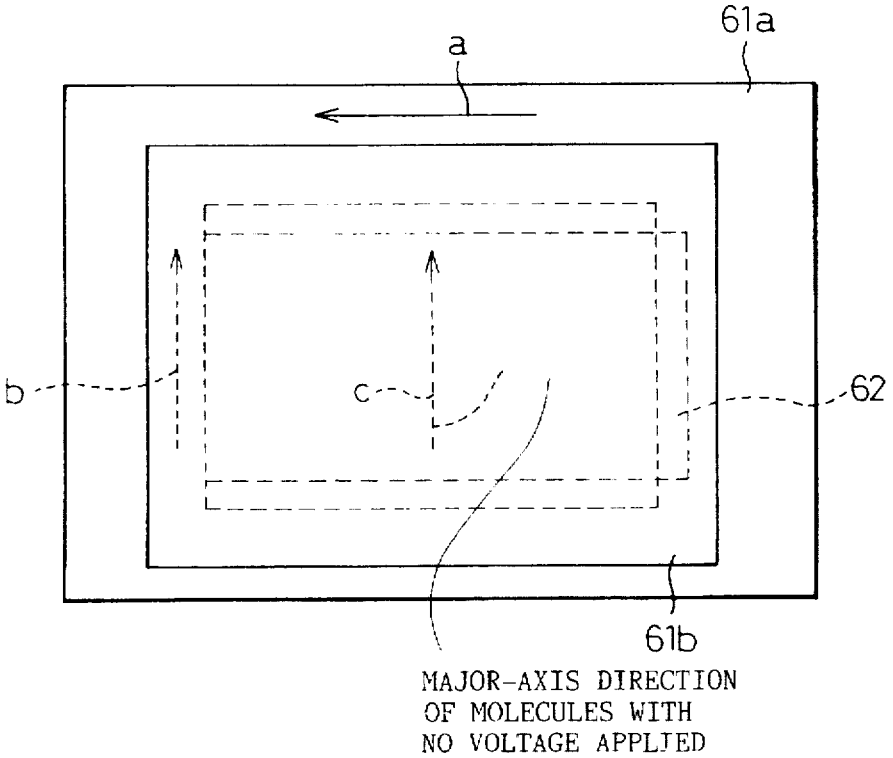
FIG. 6 is an arrangement diagram of antiferroelectric liquid-crystal cells and polarizing plates to which the present invention is adapted.

FIG. 6 is an arrangement diagram of antiferroelectric liquid-crystal cells and polarizing plates to which the present invention is adapted, showing the arrangement of the polarizing plates in the case of using an antiferroelectric liquid crystal as a display device. As illustrated, liquid-crystal cells 62 are arranged between polarizing plates 61*a* and 61*b* whose axes of polarization (arrows a and b) are matched with those of a cross-Nichol prism so that an averaged major-axis direction of molecules in the absence of an electric field will be nearly parallel to the axis of polarization of either of the polarizing plates (axis of polarization b in the drawing). When no voltage is applied, black appears, and when a voltage is applied, white appears.

Figure 7:
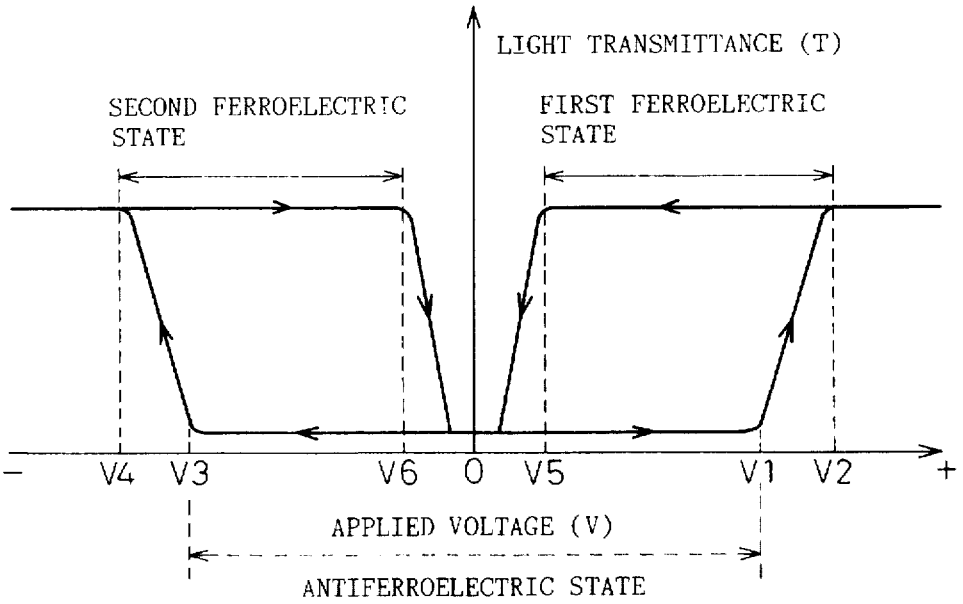
FIG. 7 is an explanatory diagram of a hysteresis curve exhibiting the characteristic of an antiferroelectric liquid crystal to which the present invention is adapted.

FIG. 7 is an explanatory diagram of a hysteresis curve exhibiting the light transmittance-versus-applied voltage characteristic of an antiferroelectric liquid-crystal display device to which the present invention is adapted. Assuming that a voltage is applied to liquid-crystal cells that are arranged as mentioned above, a change in light transmittance deriving from a change in applied voltage is graphically expressed by plotting light transmittances at different applied voltages. The axis of abscissae indicates applied voltages (V), and the axis of ordinates indicates light transmittances (or amounts of transmitted light T). As illustrated, assuming that a voltage is applied and stepped up, a voltage at which the light transmittance of an antiferroelectric liquid crystal starts changing is V1, and a voltage at which the change in light transmittance is saturated is V2. On the contrary, assuming that the applied voltage is stepped down from the saturation voltage V2, a voltage at which the light transmittance of an antiferroelectric liquid crystal starts decreasing is V5. Assuming that a voltage of opposite polarity is applied and the absolute value of the voltage is increased, a voltage at which the light transmittance of an antiferroelectric liquid crystal starts changing is V3, and a voltage at which the change in light transmittance is saturated is V4. Assuming that the absolute value of the applied voltage is decreased from the saturation voltage V4, a voltage at which the light transmittance of an antiferroelectric liquid crystal starts changing is V6.

As apparent from the graph, the relationship between the applied voltage and light transmittance is represented by the hysteresis curve. When a given voltage is applied to molecules of an antiferroelectric liquid crystal, if the applied voltage is equal to or higher than a certain threshold voltage, molecules of the antiferroelectric liquid crystal change their orientation and select a first ferroelectric state. When the polarity of the applied voltage is reversed, molecules of the antiferroelectric liquid crystal change their orientation to an opposite direction and select a second ferroelectric state. When the applied voltage (absolute value) is lower than the certain threshold voltage, an antiferroelectric state is selected.

Figure 8:
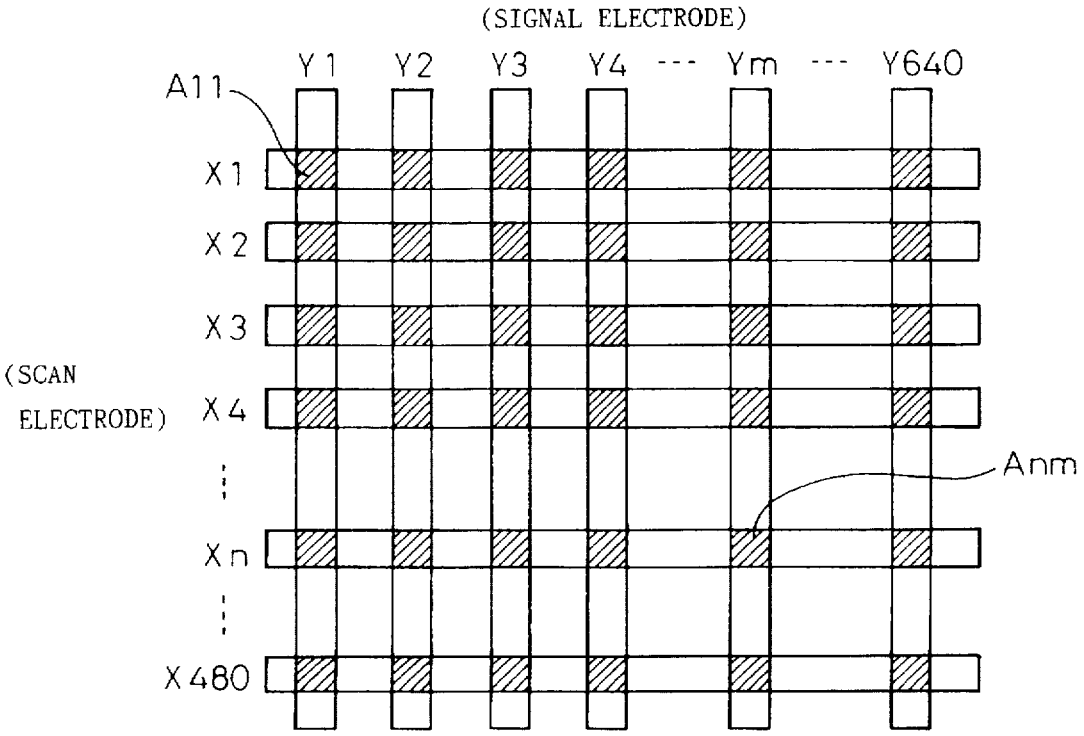
FIG. 8 is an arrangement diagram of scan electrodes and signal electrodes to which the present invention is adapted.

FIG. 8 is an arrangement diagram of scan electrodes and signal electrodes to which the present invention is adapted, showing an example in which a plurality of scan electrodes and a plurality of signal electrodes are arranged. The scan electrodes are denoted with X1, X2, etc., Xn, and X480, and the signal electrodes are denoted with Y1, Y2, etc., Yn, and Y640. Shaded areas in the drawing or intersections of the scan electrodes and signal electrodes are pixels A11 to Anm. A driving method for the pixels Anm is such that voltages are applied to scan electrodes Xn and signal electrodes Ym respectively, and a synthetic voltage of the voltages drives pixels Anm.

Taking for instance an antiferroelectric liquid-crystal panel having the foregoing structure, a known driving method and underlying problems will be described below.

Figures 9A, 9B:
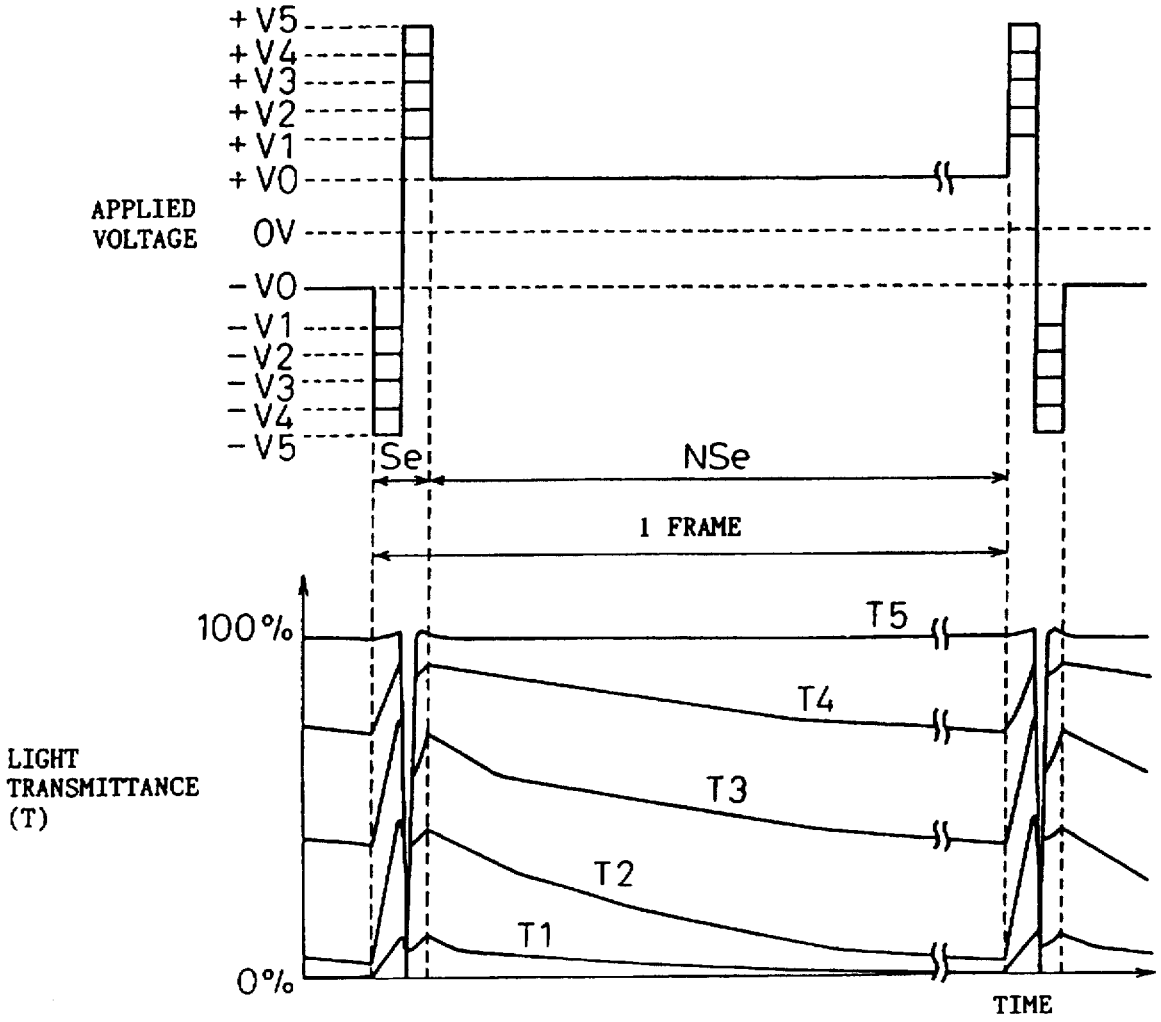
FIG. 9(A)(B) is an explanatory diagram (part 1) of a known driving method.

FIGS. 9A and 9B are explanatory diagrams (part 1) of a known driving method, illustrating a gray-scale display method for a known antiferroelectric liquid crystal. FIG. 9A is an explanatory diagram concerning a situation in which an applied voltage is changed according to gray-scale display. FIG. 9B shows a change in light transmittance T occurring when an applied voltage is changed.

One known gray-scale display method is such that a first ferroelectric state, second ferroelectric state, or antiferroelectric state is selected during a selection period (Se), the state is retained during a non-selection period (NSe) until the next selection period, and an amount of transmitted light selected during the selection period is retained during a subsequent non-selection period. Thus, gray-scale display is achieved. For carrying out gray-scale display according to this kind of driving method, a voltage to be applied during a selection period is, as illustrated, changed according to a desired state of gray-scale display (see values V1 to V5), and an amount of transmitted light associated with a given state of gray-scale display (any of values T1 to T5) is obtained.

In other words, for carrying out gray-scale display according to the above driving method, a voltage to be applied during a selection period (Se) is changed according to a desired state of gray-scale display. For example, as illustrated, when a voltage V5 is applied during a selection period, an amount of transmitted light T5 is attained during a non-selection period (NSe). When a voltage V4 is applied, an amount of transmitted light T4 is attained. When voltages V3, V2, and V1 are applied successively, the amount of transmitted light changes from value T3 through value T2 to value T1 accordingly. Thus, gray-scale display is achieved.

Figure 10:
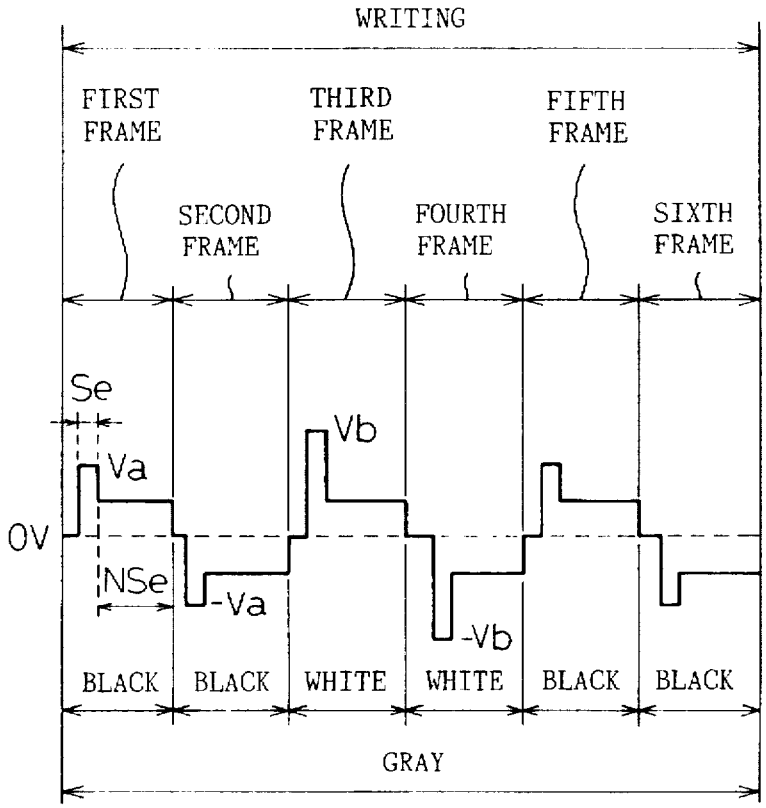
FIG. 10 is an explanatory diagram (part 2) of a known driving method.

FIG. 10 is an explanatory diagram (part 2) of a known driving method. In the drawing, Va denotes a voltage value for black display, and Vb denotes a voltage value for white display. Another known gray-scale display method is a gray-scale display method for a twisted nematic (TN) liquid crystal or super-twisted nematic (STN) liquid crystal that does not assume a ferroelectric state. Many techniques have been proposed for gray-scale display using such a liquid crystal. One of the techniques is referred to as a frame gray-scale display method in which when a writing speed for one screen is higher than a speed discernible by a human being, if writing of one screen lasts, as illustrated, for a plurality of frames, an average value of amounts of light transmitted during the frames is set as an amount of transmitted light associated with a given state of gray-scale display and discerned by a human being.

However, according to the former gray-scale display method illustrated in FIGS. 9A and 9B, that is, a method in which an antiferroelectric liquid crystal is used and a voltage to be applied during a selection period is changed according to gray-scale display, the number of output voltage levels corresponding to the number of gray-scale levels is needed. As a result, there arises a problem that an IC used for realizing the output voltage levels becomes more complex and its cost increases.

In contrast, if the latter frame gray-scale display method illustrated in FIG. 10 were adapted to an antiferroelectric liquid-crystal display device in its entirety, a problem described below would arise. This is because the principles of driving an antiferroelectric liquid crystal are different from that of driving a TN or STN liquid crystal. That is to say, in the frame gray-scale display method for a normal TN or STN liquid crystal, an applied voltage must be supplied to pixels with the polarity of the voltage reversed alternately (that is, an alternating voltage must be supplied). For reversing the polarity of an applied voltage alternately, the polarity must be reversed frame by frame. However, when an antiferroelectric liquid crystal is employed, if the polarity is reversed frame by frame, the spontaneous polarizations of the antiferroelectric liquid crystal interact. This results in a problem that polarization reverse currents flow between substrates and the power consumption of a whole display device increases.

As mentioned above, the former known gray-scale display method invites an increase in cost of a liquid-crystal display device because of the necessity of a more complex IC. The latter method brings about an increase in power consumption because the polarity of a voltage must be reversed frame by frame.

In consideration of the foregoing problems with the prior arts, an object of the present invention is to provide a gray-scale display method and system making it possible to reduce the cost of an antiferroelectric liquid-crystal display device and minimizing the power consumption thereof.

According to the present invention, (1) there is provided a driving method for an antiferroelectric liquid-crystal display device including pixels in the form of a matrix and having an antiferroelectric liquid crystal interposed between a pair of substrates, wherein writing of pixels requires at least two scanning periods, each scanning period is composed of a plurality of frames, and an average value of amounts of light transmitted during frames is set as an amount of light transmitted by pixels. The antiferroelectric liquid crystal assumes a first ferroelectric state, a second ferroelectric state to be set with application of a voltage that is opposite in polarity to a voltage to be applied to set the first ferroelectric state, and an antiferroelectric state. A frame during which the antiferroelectric liquid crystal assumes the first ferroelectric state and a frame during which the antiferroelectric liquid crystal assumes the second ferroelectric state are not included in the same scanning period.

(2) The scanning period referred to in the description of the driving method (1) is composed of frames during which the antiferroelectric liquid crystal assumes the first ferroelectric state and frames during which the antiferroelectric liquid crystal assumes the antiferroelectric state, or of frames during which the antiferroelectric liquid crystal assumes the second ferroelectric state and frames during which the antiferroelectric liquid crystal assumes the antiferroelectric state.

Preferably, in the driving methods (1) and (2), the transition from a frame during which the antiferroelectric liquid crystal assumes the antiferroelectric state to a frame during which the antiferroelectric liquid crystal assumes the first or second ferroelectric state is made at most once within the same scanning period. Otherwise, the transition from a frame during which the antiferroelectric liquid crystal assumes the first or second ferroelectric state to a frame during which the antiferroelectric liquid crystal assumes the antiferroelectric state is made at most once within the same scanning period.

(3) In an antiferroelectric liquid-crystal display device having a plurality of scan electrodes and a plurality of signal electrodes on opposed surfaces thereof and including pixels in the form of a matrix, writing of pixels requires at least two scanning periods. Each scanning period includes a plurality of frames. An average value of amounts of light transmitted during frames is adopted for gray-scale display. Each frame includes at least a selection period and non-selection period. Voltages to be applied to scan electrodes during non-selection periods within the same scanning period are set to have the same polarity.

Preferably, in the driving method (3), non-selection periods during which the antiferroelectric liquid crystal assumes different alignment states are included in at most one pair of consecutive frames within the same scanning period.

In each of the driving methods, the polarities of voltages to be applied during two consecutive scanning periods are opposite mutually with respect to 0 V. This results in an alternating voltage.

To be more specific, writing of pixels requires at least two scanning periods. Each scanning period is a period necessary to obtain a given gray-scale level, and is composed of a plurality of frames. Since a writing speed for one screen is sufficiently high, an average value of amounts of light transmitted during frames serves as an amount of transmitted light discernible by a human being within a scanning period. Differences in amount of transmitted light realize a gray-scale display. Even when the amounts of light transmitted during frames are not used as interim amounts of transmitted light and black-and-white binary display is carried out, the driving method can be adopted. An averaged amount of light to be transmitted during one scanning period can be associated not only with either of two values but also with any of a plurality of values. As a result, a human being can discern a plurality of gray-scale levels.

As mentioned above, when only two levels are represented, an applied voltage need not be changed in several steps and the number of output levels to be handled by a driving IC may be small. This means that a simply-structured IC can be employed. Consequently, the cost of a liquid-crystal display device can be reduced and excellent gray-scale display can be achieved.

As described in terms of the prior arts, when an antiferroelectric liquid crystal is used for frame-by-frame alternation, the states of the antiferroelectric liquid crystal change frame by frame from the first ferroelectric state to the second ferroelectric state or from the second ferroelectric state to the first ferroelectric state. Consequently, many polarization reverse currents flow through the liquid-crystal cells. This results in an increase in power consumption of the whole liquid-crystal display device.

However, according to the present invention, alternation is not attained on a frame-by-frame basis within one scanning period but attained between two scanning periods. Since alternation is not attained on a frame-by-frame basis, the alternation frequency can be minimized.

Figure 1:
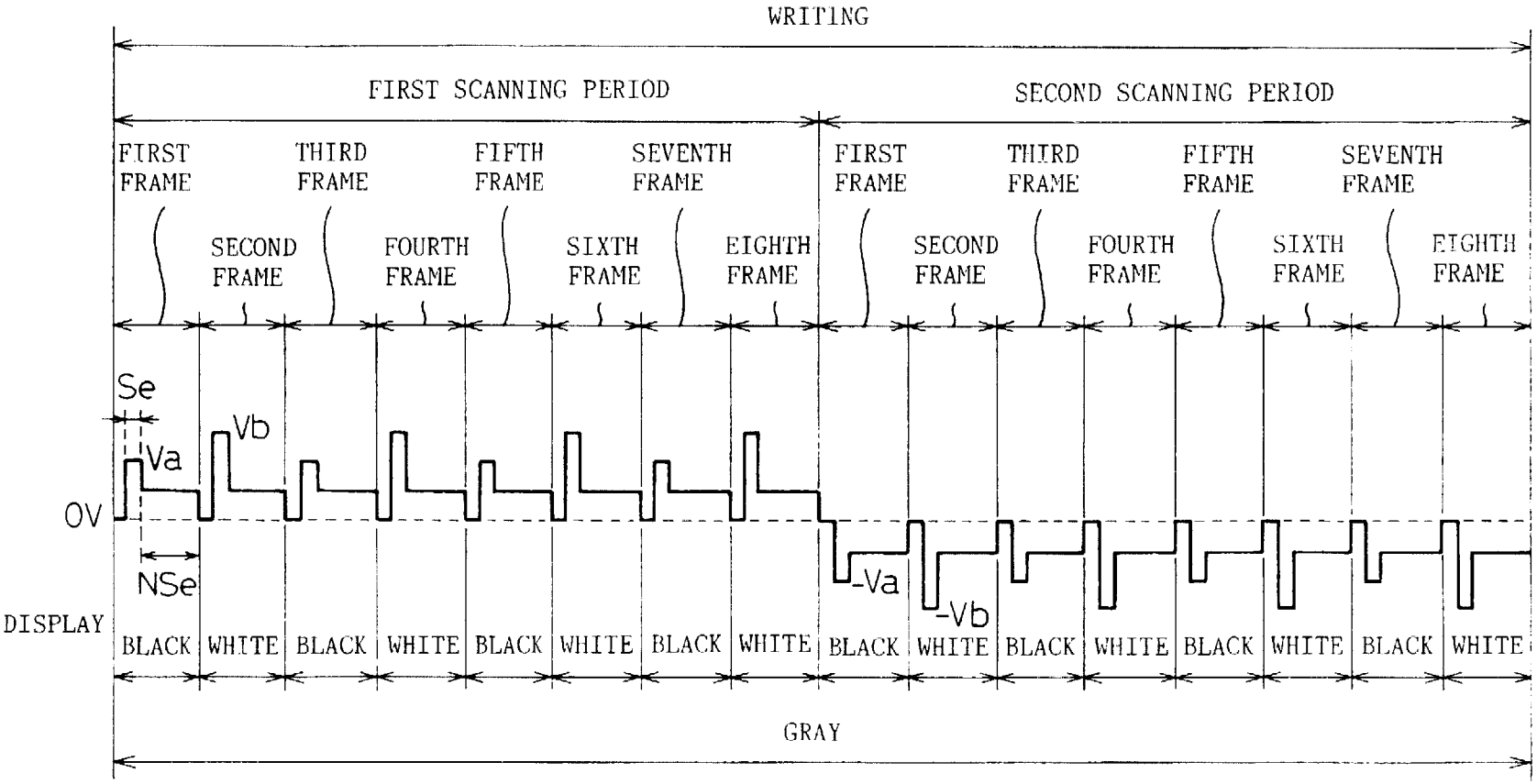
FIG. 1 is a schematic diagram of an overall waveform of driving voltages in an embodiment of the present invention.

To be more specific, a wave formed with voltages to be applied during frames within one scanning period is not symmetrical with respect to 0 V, but is, as shown in FIG. 1, symmetrical to a wave formed with voltages to be applied within an adjoining scanning period with respect to 0 V. Drive is controlled so that the antiferroelectric liquid crystal will not change from one ferroelectric state to another ferroelectric state within the same scanning period. According to the present invention, therefore, unlike the known frame gray-scale display method described in conjunction with FIG. 10, the power consumption will not increase. For carrying out multilevel gray scale, one writing requires a considerably large number of frames. The antiferroelectric liquid crystal generally has a higher response speed than the TN or STN liquid crystal, a problem of "flickering" of a screen or the like will not arise.

Moreover, when an average value of amounts of light transmitted during frames is set as an amount of light transmitted during a scanning period, various combinations of black-display and white-display frames are conceivably included in the same scanning period.

For example, if the number of frames within one scanning period is eight, for displaying an intermediate color or gray, four black-display frames and four white-display frames are needed. The combination of black-display and white-display frames may be made by assigning four leading consecutive frames to white display and four trailing consecutive frames to black display, or by arranging white-display frames and black-display frames alternately. Irrespective of the combination, the same color of gray is discerned by a human being.

However, when a transition is made from a white-display frame to a black-display frame or from a black-display frame to a white-display frame, the antiferroelectric liquid crystal changes states from a ferroelectric state to the antiferroelectric state or from the antiferroelectric state to a ferroelectric state. The ordering of the antiferroelectric liquid crystal changes more greatly than it does with a transition from a white-display frame to a white-display frame (from a ferroelectric state to the same ferroelectric state) or from a black-display frame to a black-display frame (from the antiferroelectric state to the antiferroelectric state). With a transition (from white display to black display or black display to white display), polarization reverse currents flow.

For displaying an intermediate color, the lower frequency of making a transition from a white-display frame to a black-display frame or from a black-display frame to a white-display frame within the same scanning period, that is, a smaller number of opportunities of changing the orderings of an antiferroelectric liquid crystal leads to a smaller power consumption.

Embodiments of the present invention will be described in detail in conjunction with the drawings.

Figure 5:
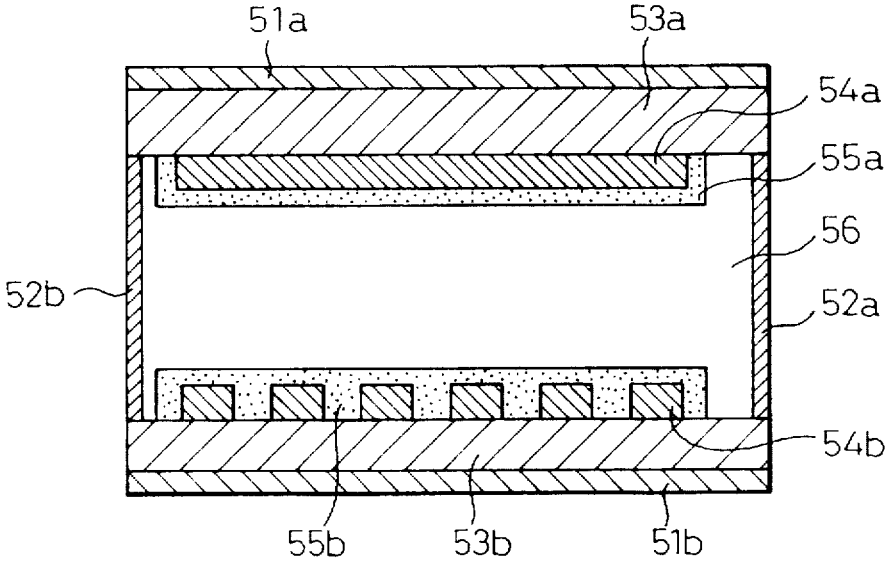
FIG. 5 is a sectional structure diagram of antiferroelectric liquid-crystal cells to which the present invention is adapted.

Prior to a driving method of an embodiment of the present invention shown in FIG. 1, the structure of a liquid-crystal panel employed in the embodiment will be described with reference to FIG. 5. The liquid-crystal panel employed in this embodiment is composed of a pair of glass substrates 53*a* and 53*b* having an antiferroelectric liquid-crystal layer 56 approximately 2 micrometers thick between them. Electrodes 54*a* and 54*b* are formed on opposed sides of the glass substrates. Polymer alignment membranes 55*a* and 55*b* are coated over the electrodes. The surfaces of the membranes are subjected to a known rubbing.

A first polarizing plate 51*a* is placed on the outer side of one of the glass substrates or the glass substrate 53a so that the axis of polarization of the polarizing plate is parallel to the axis of rubbing. A second polarizing plate 51*b* is placed on the outer side of the other glass substrate 53*b* so that the axis of polarization thereof is deviated by 90° from the axis of polarization of the first polarizing plate 51a (cross-Nichol prism). Incidentally, 52*a* and 52*b* denote seal members for immobilizing the upper and lower glass substrates.

FIG. 1 is a schematic diagram showing an overall driving wave formed with driving voltages in accordance with the present invention. A threshold voltage at which an antiferroelectric liquid crystal employed in the present invention changes to the first ferroelectric state is 20 V (V2 in FIG. 7). A threshold voltage at which the antiferroelectric liquid crystal changes to the second ferroelectric state is −20 V (V4 in FIG. 7). A wave formed with synthetic voltages to be applied during two scanning periods is used for one writing. Each scanning period is composed of eight frames. One frame during which one synthetic voltage is applied includes a selection period (Se) during which the state of the antiferroelectric liquid crystal is determined and a non-selection period (NSe). Voltages to be applied during selection periods of four frames out of eight frames constituting the first scanning period are set to value Vb (20 V). The antiferroelectric liquid crystal exhibits the first ferroelectric state, and a white display ensues. As for the other frames, voltages to be applied during selection periods thereof are set to value Va. The antiferroelectric liquid crystal exhibits the antiferroelectric state, and black display ensues.

Visual perception will be discussed. Transmittances attained during eight frames are averaged, whereby gray is discerned. Likewise, the second scanning period is composed of eight frames. Voltages to be applied during selection periods of four frames out of the eight frames are set to value −Vb (−20 V). The antiferroelectric liquid crystal exhibits the second ferroelectric state, and white display ensues. As for the other four frames, voltages to be applied during selection periods thereof are set to value −Va. The antiferroelectric liquid crystal exhibits the antiferroelectric state, and black display ensues. Like the first scanning period, gray is discerned during the second scanning period.

A wave formed with synthetic voltages to be applied during the first and second scanning periods is symmetrical with respect to 0 V. Thus, the wave is alternating with respect to 0 V. Moreover, since each scanning period is composed of eight frames, the transmittance to be attained during the scanning period can be controlled in eight steps. An eight-step gray scale can therefore be achieved.

Figure 2:
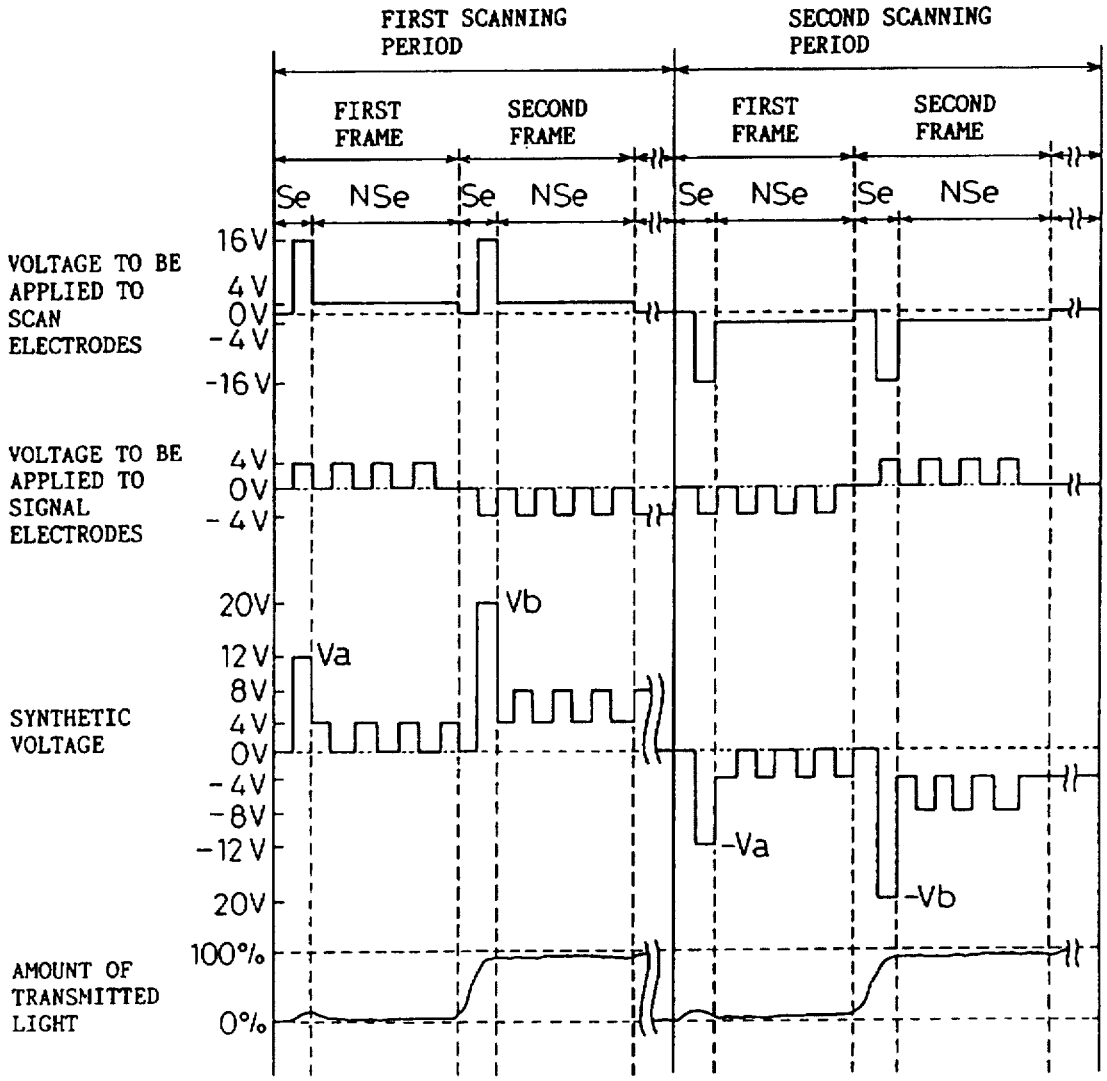
FIG. 2 shows the detailed waveforms of driving voltages to be applied during a first frame and second frame shown in FIG. 1.

FIG. 2 is a diagram showing in detail the driving wave in the embodiment shown in FIG. 1 to be formed during the first and second frames within the first scanning period and the first and second frames within the second scanning period. Each frame is composed of a selection period (Se) and non-selection period (NSe). During the selection period, the driving wave includes two phases. The pulse duration of one phase is set to 25 microseconds. The time of a non-selection period is much longer than that of a selection period or is approximately 25 milliseconds. A retaining voltage of 4 V (−4 V during the second scanning period) is applied to scan electrodes during a non-selection period.

An absolute peak value of a pulse to be applied to scan electrodes during a selection period is 16 V (−16 V during the second scanning period). An absolute peak value of a voltage to be applied to signal electrodes is 4 V. As far as the polarities of voltages to be applied to the scan electrodes during non-selection periods are concerned, the polarities are positive for either white display or black display during the first scanning period. The polarities are thus the same without any change during the scanning period.

During the second scanning period, the polarities of voltages are negative. Thus, the polarities are the same during the scanning period. During one writing, large polarization reverse currents flow only once. Consequently, an increase in current consumption of an antiferroelectric liquid-crystal display device can be sufficiently suppressed.

Figure 3:
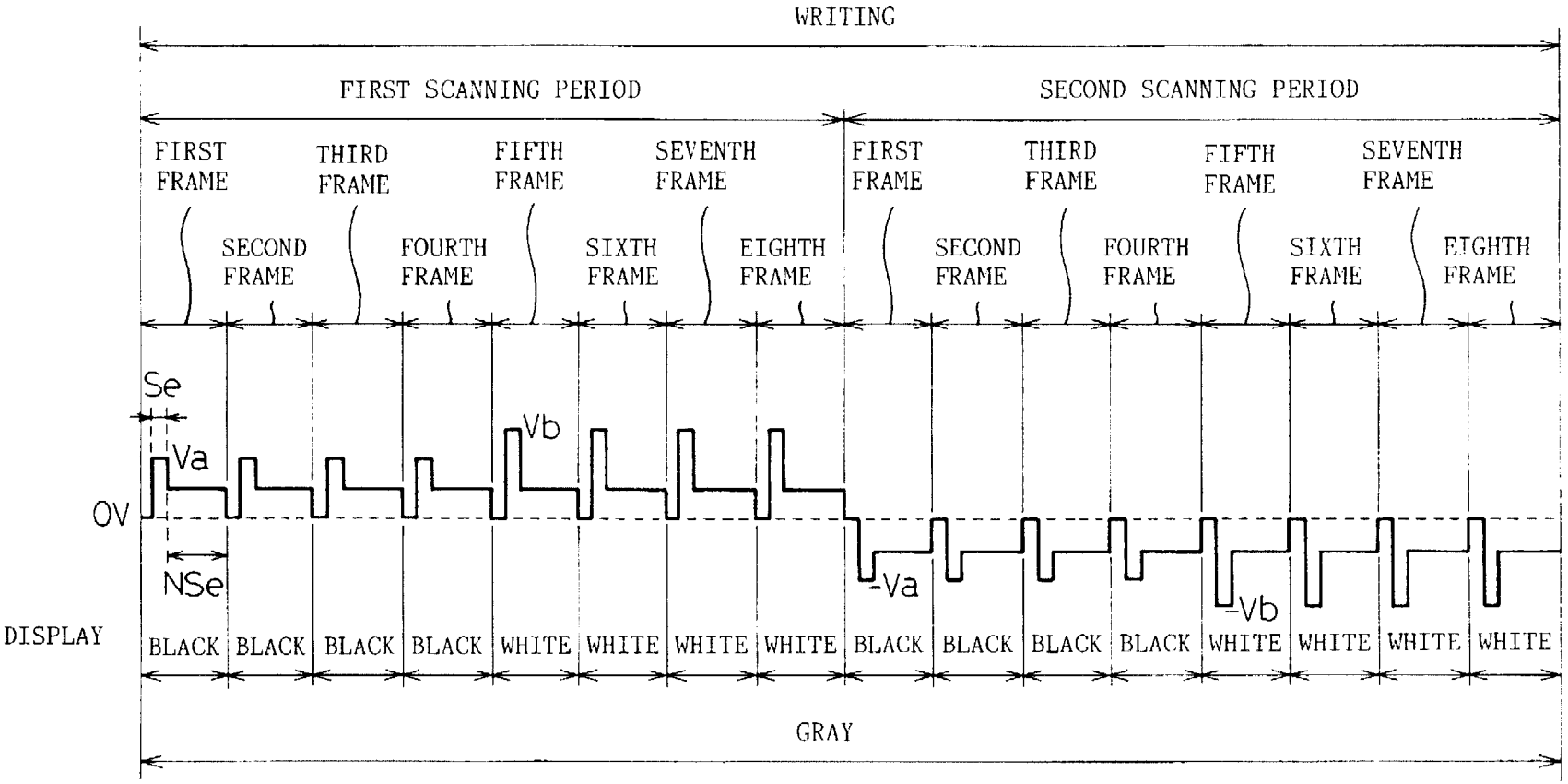
FIG. 3 is a schematic diagram of an overall waveform of driving voltages in another embodiment of the present invention.

FIG. 3 is a schematic diagram showing an overall driving wave in another embodiment of the present invention. An antiferroelectric liquid crystal providing the same driving wave as the one shown in FIG. 1 is employed. One writing requires two scanning periods. Each scanning period is composed of eight frames. Like the embodiment shown in FIG. 1, voltages to be applied during selection periods of four frames out of eight frames constituting the first scanning period are set to value Vb (20 V). The antiferroelectric liquid crystal exhibits a first ferroelectric state, and white display ensues. In contrast, the value of voltages to be applied during selection periods of the other four frames is Va. The antiferroelectric liquid crystal exhibits an antiferroelectric state. Black display ensues.

However, frames for white display and frames for black display are four consecutive frames respectively. With the illustrated driving wave, the same gray as the one permitted by the driving wave shown in FIG. 1 is discerned. The transition from the antiferroelectric state to the ferroelectric state is made only once within the same scanning period. In other words, the ordering of the molecules of the antiferroelectric liquid crystal is changed only once. Consequently, the power consumption can be suppressed more greatly.

This embodiment is concerned with drive of a display device having a plurality of scan electrodes and a plurality of signal electrodes. Alternatively, when a display device to be driven adopts active elements such as switching elements as pixels, as long as a driving wave to be applied to pixels is similar to the wave formed with synthetic voltages in this embodiment, the same advantage as the one provided by this embodiment can be provided.

In this embodiment, a simply-structured IC capable of outputting two kinds of voltages; ON-state and OFF-state voltages is used as a driving IC. Since one scanning period is composed of eight frames, display with nine gray-scale levels can be achieved.

Figure 4:
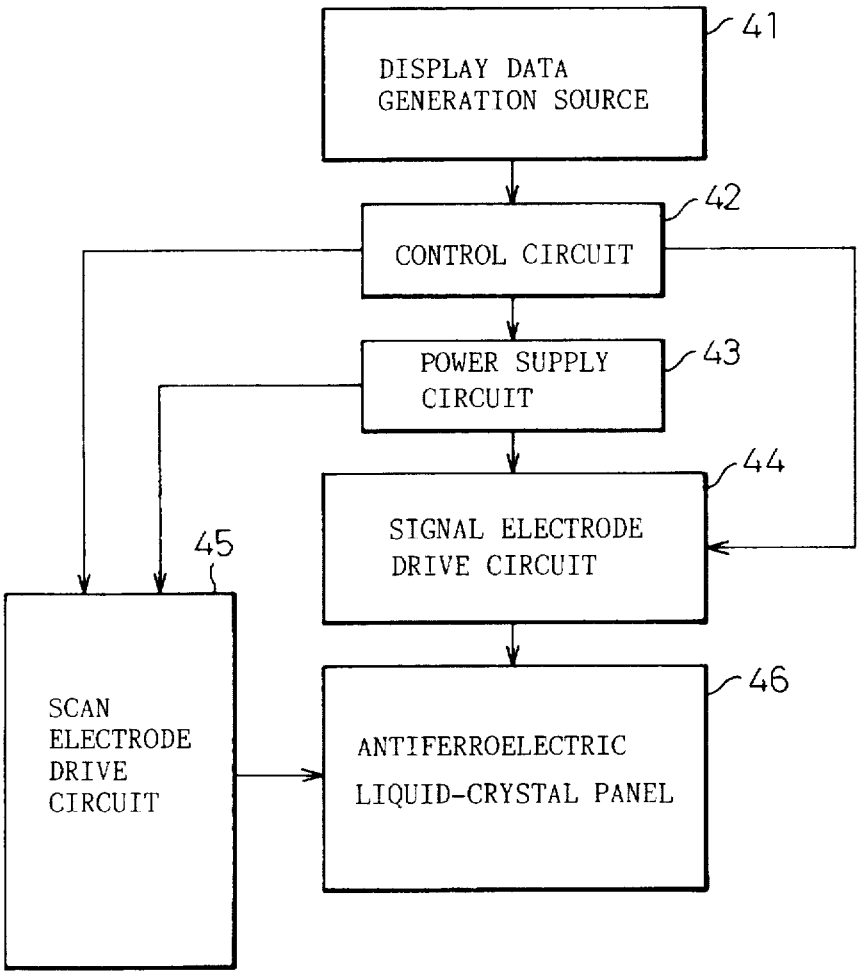
FIG. 4 is a block diagram of a system in which the present invention is implemented.

FIG. 4 is a block configuration diagram of a system in which the present invention is implemented. In the drawing, there are shown a display data generation source 41 for generating data to be displayed on a liquid-crystal panel 46, and a control circuit 42 for controlling a scan electrode drive circuit 45 and signal electrode drive circuit 44 for the purpose of controlling a driving wave that lasts for the first and second scanning periods on the basis of the display data sent from the display data generation source 41. The control circuit 42 controls the timing of supplying power from a power supply circuit 43 to electrodes.

First, display data is input to the control circuit 42. The control circuit 42 produces information of the timing and voltage values of signals according to either of the driving waves shown in FIGS. 1 to 3, and inputs the information to the scan electrode drive circuit 45 and signal electrode drive circuit 44 respectively. Voltages having the timing and values of signals provided by the control circuit 42 are output to the antiferroelectric liquid-crystal panel 46 through the output pins of the drive circuits.

INDUSTRIAL APPLICABILITY

As described in conjunction with the embodiments, using the driving method or, in particular, the gray-scale display method of the present invention, gray-scale display can be achieved on an antiferroelectric liquid-crystal display device at low cost without the necessity of setting a plurality of applied voltages and without an increase in current consumption. Since the response speed of the antiferroelectric liquid crystal is sufficiently high, excellent display performance can be ensured without a problem such as "flickering" of a screen.

I claim:

1. A driving method for an antiferroelectric liquid-crystal display device including pixels in the form of a matrix and having an antiferroelectric liquid crystal interposed between a pair of substrates, characterized in that:

said antiferroelectric liquid crystal assumes a first ferroelectric state, a second ferroelectric state to be set with application of a voltage that is opposite in polarity to a voltage to be applied to set the first, ferroelectric state, and an antiferroelectric state;

writing of pixels is carried out during at least two consecutive scanning periods, each scanning period being composed of a plurality of frames;

an average value of amounts of light transmitted during said plurality of frames is set as an amount of light transmitted by pixels; and both frames during which said antiferroelectric liquid crystal assumes the first ferroelectric state and frames during which said antiferroelectric liquid crystal assumes the second ferroelectric state are not included in the same scanning period.

2. A driving method for an antiferroelectric liquid-crystal display device including pixels in the form of a matrix and having an antiferroelectric liquid crystal interposed between a pair of substrates, characterized in that:

said antiferroelectric liquid crystal assumes a first ferroelectric state, a second ferroelectric state to be set with application of a voltage that is opposite in polarity to a voltage to be applied to set the first ferroelectric state, and an antiferroelectric state;

writing of pixels is carried out during at least two consecutive scanning periods, each scanning period being composed of a plurality of frames;

an average value of amounts of light transmitted during said plurality of frames is set as an amount of light transmitted by pixels; and one scanning period is composed of frames during which said antiferroelectric liquid crystal assumes the first ferroelectric state and frames during which said antiferroelectric liquid crystal assumes the antiferroelectric state, or of frames during which said antiferroelectric liquid crystal assumes the second ferroelectric state and frames during which said antiferroelectric liquid crystal assumes the antiferroelectric state.

3. A driving method for an antiferroelectric liquid-crystal display device according to claim 1 or 2, wherein the transition from a frame during which said antiferroelectric liquid crystal assumes the antiferroelectric state to a frame during which said antiferroelectric liquid crystal assumes the first ferroelectric state or second ferroelectric state, or the transition from a frame during which said antiferroelectric liquid crystal assumes the first ferroelectric state or second ferroelectric state to a frame during which said antiferroelectric liquid crystal assumes the antiferroelectric state is made at most only once within the same scanning period.

4. A driving method for an antiferroelectric liquid-crystal display device including pixels in the form of a matrix and having an antiferroelectric liquid crystal interposed between a pair of substrates that have a plurality of scan electrodes and a plurality of signal electrodes on opposed sides thereof, characterized in that:

said antiferroelectric liquid crystal assumes three orderings; a first ferroelectric state, a second ferroelectric state to be set with application of a voltage that is opposite in polarity to a voltage to be applied to set the first ferroelectric state, and an antiferroelectric state;

writing of pixels located at positions at which said scan electrodes and signal electrodes are mutually opposed is carried out during at least two consecutive scanning periods, each scanning period being composed of a plurality of frames;

an average value of amounts of light transmitted during said plurality of frames is set as an amount of light transmitted by pixels; and each of said plurality of frames includes at least a selection period during which one of three orderings of said antiferroelectric liquid crystal is determined, and a non-selection period during which an ordering of said antiferroelectric liquid crystal determined during the selection period is retained, and voltages to be applied to scan electrodes during non-selection periods within the same scanning period are set to have the same polarity.

5. A driving method for an antiferroelectric liquid-crystal display device according to claim 4, wherein non-selection periods during which said antiferroelectric liquid crystal assumes different orderings are included in at most only one pair of consecutive frames within the same scanning period.

6. A driving method for an antiferroelectric liquid-crystal display device according to any of claims 1 to 5, wherein the polarities of voltages to be applied during two consecutive scanning periods are mutually opposite with respect to 0 V.

7. A driving system for an antiferroelectric liquid-crystal display device including pixels in the form of a matrix and having an antiferroelectric liquid crystal interposed between a pair of substrates, comprising:

a means for generating display data;

a means for driving scan electrodes;

a means for driving signal electrodes;

a power supply means for supplying a given voltage to pixels; and a control means for receiving display data, producing the timing and voltage values of signals corresponding to the display data, and supplying the timing and voltage values to said scan electrode driving means and signal electrode driving means, wherein said control means gives control so that:

writing of pixels is carried out during at least two consecutive scanning periods, each scanning period being composed of a plurality of frames;

an average value of amounts of light transmitted during said plurality of frames is set as an amount of light transmitted by pixels; and both frames during which said antiferroelectric liquid crystal assumes a first ferroelectric state and frames during which said antiferroelectric liquid crystal assumes a second ferroelectric state are not included in the same scanning period.

8. A driving system for an antiferroelectric liquid-crystal display device including pixels in the form of a matrix and having an antiferroelectric liquid crystal interposed between a pair of substrates, comprising:

a means for generating display data;

a means for driving scan electrodes;

a means for driving signal electrodes;

a power supply means for supplying a given voltage to pixels; and a control means for receiving display data, producing the timing and voltage values of signals corresponding to the display data, and supplying the timing and voltage values to said scan electrode driving means and signal electrode driving means;

wherein said control means gives control so that:

writing of pixels is carried out during at least two consecutive scanning periods, each scanning period being composed of a plurality of frames;

an average value of amounts of light transmitted during said plurality of frames is set as an amount of light transmitted by pixels; and one scanning period is composed of frames during which said antiferroelectric liquid crystal assumes a first ferroelectric state and frames during which said antiferroelectric liquid crystal assumes an antiferroelectric state, or of frames during which said antiferroelectric liquid crystal assumes a second ferroelectric state and frames during which said antiferroelectric liquid crystal assumes the antiferroelectric state.

9. A driving system for an antiferroelectric liquid-crystal display device according to claim 7 or 8, wherein said control means gives control so that the transition from a frame during which said antiferroelectric liquid crystal assumes the antiferroelectric state to a frame during which said antiferroelectric liquid crystal assumes the first ferroelectric state, or second ferroelectric state or the transition from a frame during which said antiferroelectric liquid crystal assumes the first ferroelectric state or second ferroelectric state to a frame during which said antiferroelectric liquid crystal assumes the antiferroelectric state is made at most only once within the same scanning period.

10. A driving system for an antiferroelectric liquid-crystal display device including pixels in the form of a matrix and having an antiferroelectric liquid crystal interposed between a pair of substrates that have a plurality of scan electrodes and a plurality of signal electrodes on opposed sides thereof, comprising:

a means for generating display data;

a means for driving scan electrodes;

a means for driving signal electrodes;

a power supply means for supplying a given voltage to pixels; and a control means for receiving display data, producing the timing and voltage values of signals corresponding to the display data, and supplying the timing and voltage values to said scan electrode driving means and signal electrode driving means, wherein said control means gives control so that:

writing of said pixels located at positions at which said scan electrodes and signal electrodes are mutually opposed is carried out during at least two consecutive scanning periods, each scanning period being composed of a plurality of frames;

an average value of amounts of light transmitted during said plurality of frames is set as an amount of light transmitted by pixels; and each of said plurality of frames includes at least a selection period during which one of orderings of said antiferroelectric liquid crystal is determined, and a non-selection period during which an ordering of said antiferroelectric liquid crystal determined during the selection period is retained, and voltages to be applied to scan electrodes during non-selection periods within the same scanning period are set to have the same polarity.

11. A driving system for an antiferroelectric liquid-crystal display device according to claim 10, wherein said control means gives control so that non-selection periods during which said antiferroelectric liquid crystal assumes different orderings are included in at most only one pair of consecutive frames within the same scanning period.

12. A driving system for an antiferroelectric liquid-crystal display device according to any of claims 7 to 11, wherein said control means gives control so that the polarities of voltages to be applied during two consecutive scanning periods are mutually opposite with respect to 0 V.

* * * * *